US007743474B2

(12) United States Patent
May

(10) Patent No.: US 7,743,474 B2
(45) Date of Patent: Jun. 29, 2010

(54) POLYMERIC PACKAGE CLOSURE AND METHOD

(75) Inventor: Timothy James May, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 737 days.

(21) Appl. No.: 11/382,136

(22) Filed: May 8, 2006

(65) Prior Publication Data

US 2007/0098304 A1 May 3, 2007

Related U.S. Application Data

(60) Provisional application No. 60/732,331, filed on Oct. 31, 2005.

(51) Int. Cl.
*B65D 33/16* (2006.01)

(52) U.S. Cl. ..... 24/585.12; 24/DIG. 50

(58) Field of Classification Search ..... 24/585.12, 24/399, 400, DIG. 39, DIG. 40, DIG. 50; 392/61.2, 61.3, 63, 64
See application file for complete search history.

(56) References Cited

U.S. PATENT DOCUMENTS 4,186,786 A 2/1980 Kirkpatrick
4,285,105 A 8/1981 Kirkpatrick
4,363,345 A 12/1982 Scheibner
4,787,880 A 11/1988 Ausnit
4,822,539 A 4/1989 Tilman et al.
4,854,017 A 8/1989 Kamp
5,066,444 A 11/1991 Behr
5,070,584 A 12/1991 Dais et al.
5,356,222 A * 10/1994 Kettner et al. ..... 383/63
5,566,429 A 10/1996 Martinez et al.
5,725,312 A 3/1998 May
6,925,688 B1 8/2005 Savicki
2004/0078940 A1 4/2004 Ishizaki
2004/0098845 A1 5/2004 Fukumori et al.
2005/0063621 A1 3/2005 Kettner et al.

FOREIGN PATENT DOCUMENTS

GB 2 391 259 2/2004
WO WO 0194226 A1 * 12/2001

* cited by examiner

*Primary Examiner*—James R Brittain
(74) *Attorney, Agent, or Firm*—Merchant & Gould P.C.

(57) ABSTRACT

A zipper closure for a polymeric package includes a plurality of profile members on a first polymeric surface, where one and not more than one of these plurality of profile members is colored differently from the remaining profile members on the same polymeric surface. The differently colored profile members provide a visual reference for properly orienting the zipper closure to the polymeric packaging during manufacture.

6 Claims, 2 Drawing Sheets

POLYMERIC PACKAGE CLOSURE AND METHOD

CROSS-REFERENCE TO RELATED APPLICATIONS

This application claims the benefit of U.S. Provisional Patent Application Ser. No. 60/732,331, filed Oct. 31, 2005, entitled Polymeric Package Closure And Method; Application No. 60/732,331 is incorporated herein by reference in its entirety.

TECHNICAL FIELD

This disclosure generally relates to closure arrangements for polymeric packages, and, in particular, to a resealable closure arrangement having a zipper closure, and methods of manufacturing polymeric packages.

BACKGROUND

Flexible polymeric packages may be used to hold a variety of products. Such products may be a variety of edible food products such as cheese, meat, crackers, sugar, powdered sugar, flour, salt, and baking soda, or non-food products such as laundry detergent, sand, medical supplies, and other products. Resealable packages are convenient because they can be closed and resealed to preserve and contain the enclosed contents. Resealable packages are also advantageous because they help prevent food products from spoiling and may be opened and closed multiple times.

Zipper closures are often employed to allow a polymeric package to be sealed and re-sealed. These closures are required to both seal the package tightly so that the contents do not leak or spoil, while at the same time allow the closure to be opened and closed without excessive force. To accomplish this, a zipper closure may be designed so that the seal formed by the zipper closure is more secure in the direction facing the contents of the package than the seal is in the direction facing away from the contents of the package. This arrangement allows the package to be opened by the user with a relatively small amount of effort, but also ensures that the package contents are adequately contained against accidental opening.

A problem arises, however, in the manufacture of polymeric packages where the zipper closure must have a certain orientation relative to the rest of the package. Zipper closures are typically provided on a production line as a rolled strip of material. The operator feeds this material into a machine that attaches the zipper closure strip to the rest of the polymeric package. The proper orientation of the zipper closure can be difficult to determine reliably. The features that cause the zipper closure to have a greater sealing force in one direction than the other are not such that they are readily perceptible to the operator. Because of this lack of easy perceptibility, the machine operator may misfeed the zipper closure strip into the manufacturing machinery, causing the resulting package to have sealing forces that are the opposite of that desired. Namely, a misfed zipper closure would result in a package where a greater force is required by the user to open the package and a lesser force seals the contents of the package. It is therefore desired that a zipper closure be configured so that the manufacturing machine operator can reliably and readily feed the zipper closure strip into the machinery in the correct orientation.

SUMMARY OF THE DISCLOSURE

In one aspect, a zipper closure is formed of a plurality of profile members on opposing polymeric surfaces. Profile members may include, for example, a male profile member, a female profile member, or a post. On a first polymeric surface, the zipper profile includes a plurality of profile members, where one, and not more than one, of the profile members has a first color and the remaining profile members are either clear, a color different from the first color, or a combination of clear and different from the first color. On a second polymeric surface, the zipper profile includes at least one profile member. The zipper profiles on the first and second polymeric surfaces are constructed and arranged to mate and unmate.

In another aspect, a polymeric package is formed of polymeric film that defines package walls and an open package mouth. A zipper closure is oriented along the mouth to provide selective opening and closing of the mouth, the zipper closure including a plurality of profile members on opposing polymeric surfaces. On a first polymeric surface, the zipper profile includes a plurality of profile members, where one, and not more than one, of the profile members has a first color and the remaining profile members are either clear, a color different from the first color, or a combination of clear and different from the first color. On a second polymeric surface, the zipper profile includes at least one profile member.

In yet another aspect, a method of manufacturing a polymeric package is disclosed. The method includes providing a polymeric film defining package walls and an open package mouth and providing a zipper closure for the selective opening and closing of the package mouth. The zipper closure is oriented to the package walls based on a visual indicator on the zipper closure. For example, where the zipper closure includes a first zipper profile with one, and not more than one, profile member having a first color and where the remaining profile members are clear, a color different from the first color, or a combination of clear and a color different from the first color, and the second zipper profile includes at least one profile member, the zipper profile is oriented to the package walls by seeing the first color and orienting the zipper closure based on the location of the first color. The zipper closure is then attached to the polymeric film proximate to the package mouth.

The above summary is not intended to describe each illustrated embodiment or every implementation of the present invention. The figures and detailed description that follow more particularly exemplify these embodiments.

DETAILED DESCRIPTION

The present invention is believed to be applicable to a variety of packaging arrangements. The invention has been found to be particularly advantageous for use in sealing mechanisms for polymeric packages. An appreciation of various aspects of the invention is best gained through a discussion of an application example for such a packaging arrangement.

Figure 1:
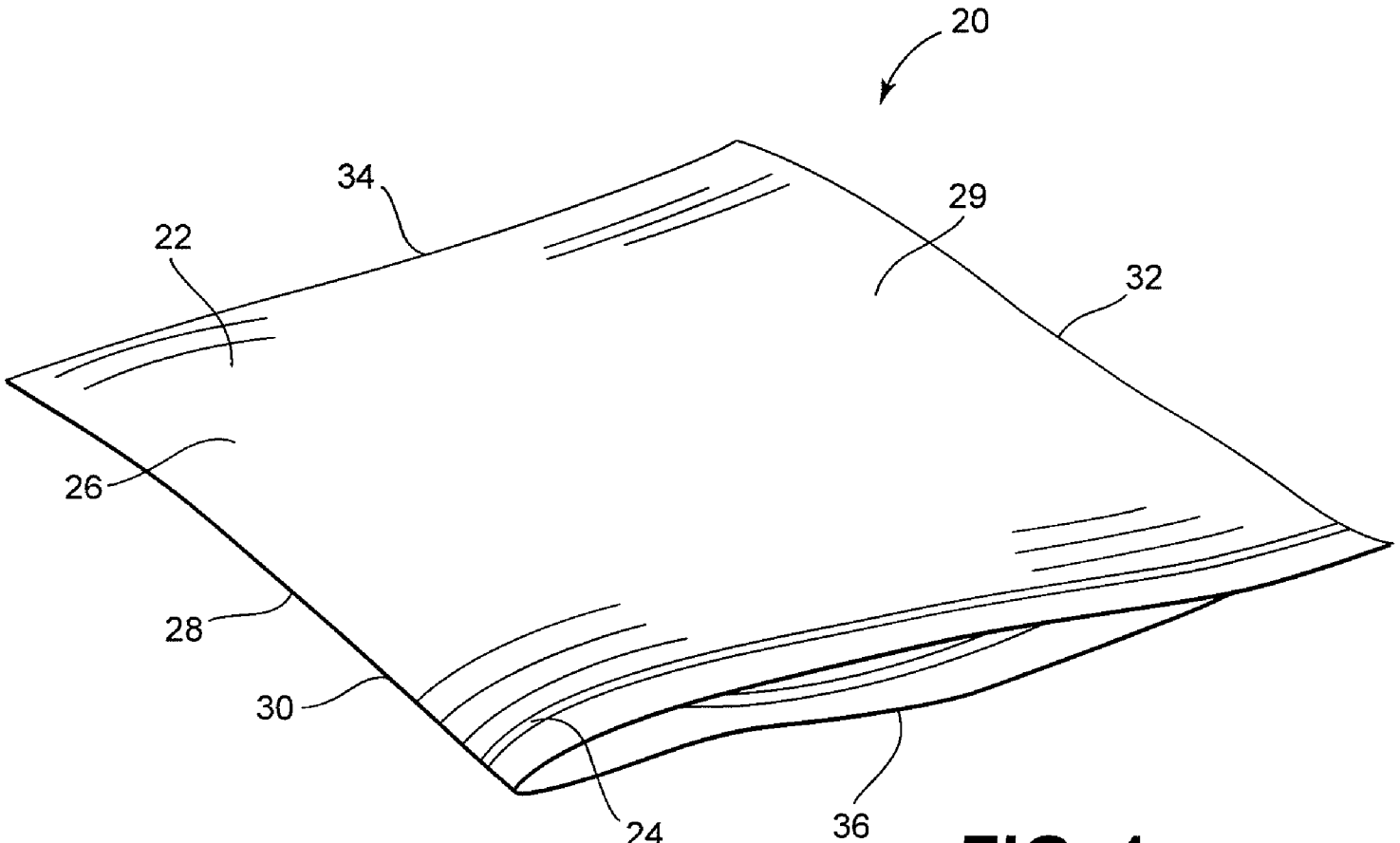
FIG. 1 is a perspective view of a polymeric package.

FIG. 1 illustrates an example polymeric package 20 constructed in accordance with the present invention. Polymeric package 20 comprises flexible package 22 and zipper closure 24. Flexible package 22 includes first panel section 26 and second, opposed, panel section 28, made from a flexible, polymeric film 29. Panel sections 26, 28 form package walls that define an interior of package 20. For some manufacturing applications, the first and second panel sections 26, 28 are heat-sealed together along two edges 30, 32 and meet at a fold line in order to form a three-edged containment section for a product within the interior of the package 22. The fold line comprises the bottom edge 34. Alternatively, two separate panel sections 26, 28 of polymeric film 29 may be used and heat-sealed together along the two edges 30, 32 and at the bottom 34. Access is provided to the interior of the package 20 through a mouth 36.

Figure 2:
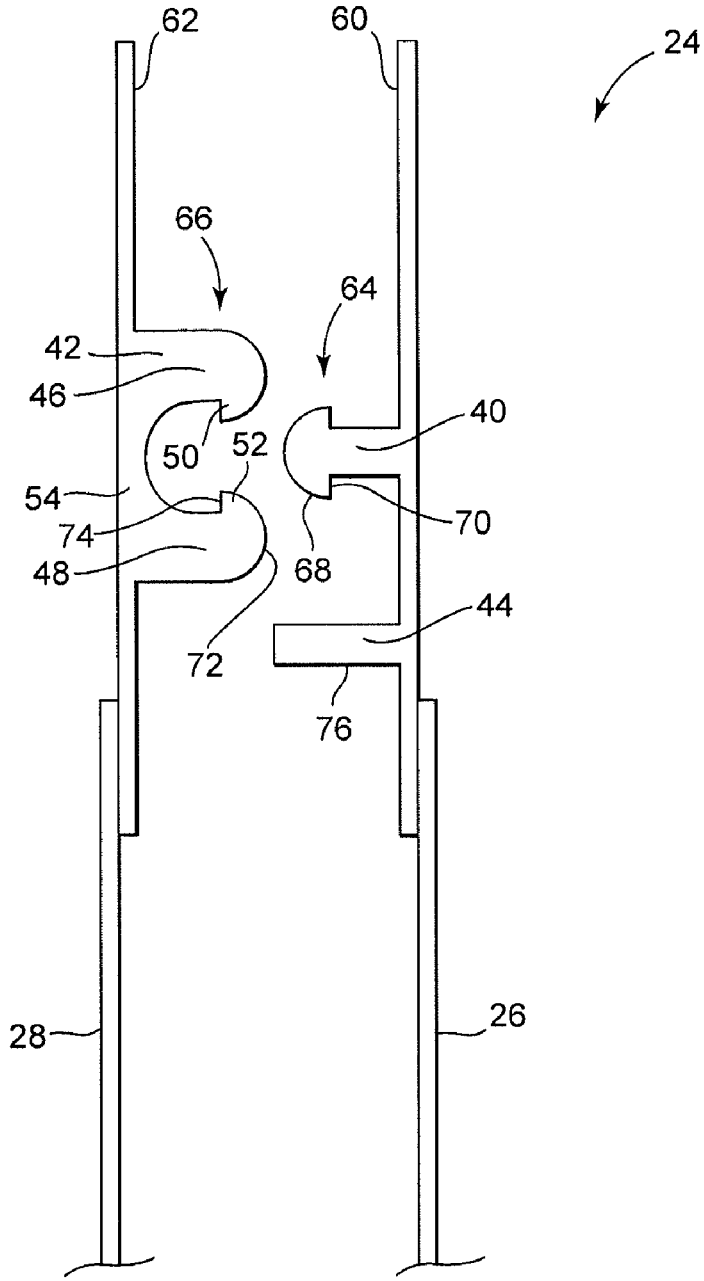
FIG. 2 is a cross sectional view of a zipper closure attached to a polymeric package.

A resealable zipper closure 24 is illustrated in FIG. 1 along the mouth 36 of the flexible package 20. The zipper closure 24 typically extends the width of the package 20. Attention is now directed to FIG. 2, which is a cross sectional view of zipper closure 24. Zipper closure 24 comprises first and second, opposing, surfaces of polymeric material 60, 62. The first polymeric surface 60 includes a first zipper profile 64 and the second polymeric 62 surface includes a second zipper profile 66. The first zipper profile 64 includes a plurality of profile members. A profile member is a feature that protrudes away from one of first or second opposing surfaces 60, 62. A profile member also comprises a generally uniform cross-sectional profile at each point along an operative width of zipper closure 24, such that the cross-sectional profile of a profile member does not vary significantly between a first point along zipper closure 24 and a second point along zipper closure 24. For example, the profile members on a first zipper profile 64 may include a male member 40 and a post member 44.

The second zipper profile 66 includes at least one profile member. For example, the second zipper profile may include a female member 42 constructed and arranged to selectively mate and unmate with the male profile member 40.

In the particular embodiment shown in FIG. 2, the male member 40 is generally T-shaped, comprising a rounded forward profile 68 and a straight underside profile 70. The female member 42, in the embodiment shown, is configured to selectively mate and unmate with the male member 40, comprising first and second legs 46, 48. The first and second legs 46, 48 each has a generally J-shaped cross section and interlocking members 50, 52, where each interlocking member 50, 52 has a rounded forward portion 72 and a straight underside profile 74. The interlocking members 50, 52 mechanically engage with the male member 40 in order to seal the package 20 by virtue of contact between the straight underside profile 70 of the male member 40 and the straight underside profile 74 of the female member 42. The first and second legs 46, 48 of the female member 42 are joined by a common base 54.

To seal the package 20, pressure is applied to male member 40 and female member 42 in an assembling direction that forces male member 40 into register with female member 42. The straight underside profile 74 of interlocking members 50, 52 engages with the straight underside profile 70 of male member 40 to provide a positive, locking seal. In order to un-seal the package, sufficient force is applied in a disassembling direction to male member 40 and female member 42 to deform interlocking members 50, 52 of the female member 42 and the straight underside profile 70 of the male member 40 so that the male member 40 pulls free of the female member 42 and opens the package 20.

The geometry of the male member 40 and female member 42 together determine the strength of the seal formed when the two components are in registration. For example, a tighter seal can be made in one direction by making the interlocking member 50, 52 proximate to that direction stiffer than the interlocking member distant from that direction. An interlocking member 50, 52 can be made stiffer by making it thicker or by forming it out of a stiffer material.

Post 44 serves to promote the consistency and quality of the seal by assisting in aligning the male member 40 to female member 42 during a sealing operation. If the male member 40 is slightly misaligned to the female member 42, post 44 will contact an interlocking member 50, 52 as the male member 40 is brought closer to female member 42, and on account of the curvature of the surface of the interlocking member 50, 52, further motion will tend to cause the post 44 to slide off of the interlocking member and thereby pull the male member 40 into alignment with the female member 42. Although post member 44 is shown in FIG. 2 as formed on the same surface as male member 40, post member 44 may alternatively be formed on the opposite surface or in other configurations. In the embodiment shown, the post 44 is a generally straight member 76 having a rectangular cross-section.

During manufacture, zipper closure 24 is typically provided as a long strip of material, such as a roll, that is attached to the package walls 26, 28 along the mouth 36 for the length of the package 20 and cut to length. For example, the zipper closure 24 may be attached to flexible package 22 by a heat seal to package walls 26, 28. In some package designs, it can be important that zipper closure 24 be attached to flexible package 22 in a particular orientation. For example, packages 22 in which the zipper closure 24 is configured to have a greater sealing force in one direction than the other direction will require the zipper closure 24 to be applied along the mouth 36 in a particular orientation. For example, the zipper closure 24 can be configured so that the force required to open the seal from the direction of the contents of the flexible package 22 is greater than the force required to open the seal from the opposite direction. This arrangement promotes robust sealing of the contents of the package 20 from spoilage and spillage while ensuring that the package 20 can be readily opened when desired.

In these types of packages, a machine operator must feed the zipper closure 24 strip or roll of material into the machine that attaches the zipper closure 24 to flexible package 22 in a particular orientation. If the operator feeds the zipper closure 24 into the machine in the wrong orientation, the resulting package 20 will have the undesirable properties that the force required to open the package from the direction of the contents will be relatively low, and the force required to open the package from the opposite direction will be relatively large. This may cause the contents of the package to not be adequately contained within the package, possibly resulting in spillage or spoilage. It may also cause difficulty by the consumer in opening the package.

In accordance with the principles of this disclosure, the zipper closure 24 includes a visual indicator to signal to the operator how the zipper closure 24 should be oriented relative to the rest of polymeric package 20. As embodied herein, the visual indicator is color that can readily be perceived under ordinary lighting conditions. In particular, one of the profile members of the first or second zipper profile 64, 66, and not more than one, has a first visible color. Preferably, a colored profile member is colored throughout its entire cross-section. The remaining profile members on the first or second zipper profile 64, 66 are either clear, a color different from the first visible color, or a combination of clear and a color different from the first visible color. A different color is one that can readily be visually perceived under ordinary lighting conditions as different and distinguished visually. In this embodiment, one of the profile members of the first zipper profile 64 is a first visible color that is visibly different from other profile members on the first zipper profile 64. For example, the post member 44 of the first zipper profile may be the first visible color, such as red, and the male member 40 may be clear (non-colored) or a color different from red. Other colors may be used; for example, yellow, green, or blue.

In this manner, when the operator is feeding the zipper closure into the manufacturing machinery, the operator can see the color of the post 44 and can orient the zipper closure 24 to the package walls 26, 28 based on the location of the color, so that the colored post 44 is proximate to the flexible package 22, instead of being positioned in the incorrect orientation. Because the color is visible under ordinary lighting conditions, it is not necessary to provide specialized equipment or procedures for determining the proper orientation of the zipper closure 24 to the package walls 26, 28.

In use, a polymeric package, such as package 20, can be manufactured by providing a polymeric film, such as film 29, defining walls 26, 28 and open mouth 36. Zipper closure 24 is provided to open and close the mouth 36. Zipper closure 24 is oriented to the package walls 26, 28 based on a visual indicator on the zipper closure 24 and then is attached to the mouth 36. For example, the visual indicator can be seeing a first visible color on one of the profile members 40, 42, 44 and orienting zipper closure 24 to the rest of package 20 according to the orientation of the first visible color. The visual indicator can be seen under ordinary lighting conditions. The zipper closure 24 can then be attached to the package 20 in the proper orientation. For example, in one embodiment, the post 44 is colored a first visible color, such as red, and the male member 42 is a color visibly different than red or is uncolored. Alternatively, the first visible color may be green, yellow, blue, or any other color. In this case, the machine operator will be able to see the colored post 44 and properly orient the zipper closure 24 so that the colored post 44 is closer to the bag walls 26, 28 and the male member 42 is more remote from the mouth 36 of the package 20. This method of manufacturing is advantageous because it does not require specialized equipment to determine the proper orientation of the zipper closure 24 to the package walls 26, 28.

The above specification and examples are believed to provide a complete description of the manufacture and use of particular embodiments of the invention. Because many embodiments of the invention can be made without departing from the spirit and scope of the invention, the true scope and spirit of the invention reside in the broad meaning of the claims hereinafter appended.

What is claimed is:

1. A zipper closure for use with a polymeric package, comprising:

(a) first and second opposing polymeric surfaces;

(b) a first zipper profile on the first polymeric surface; the first zipper profile including a plurality of profile members projecting from the first polymeric surface, the profile members being arranged on the polymeric surface such that a first profile member is closer to a first side of the zipper closure than a second profile member, wherein each profile member comprises a generally uniform cross-sectional profile along an operative length of the zipper closure;

(i) only the first profile member of the first zipper profile has a first visible color and remaining ones of the profile members on the first zipper profile are at least one of: clear, a color different from the first visible color, or a combination of clear and a color different from the first visible color; and (c) a second zipper profile on the second polymeric surface; the second zipper profile including at least one profile member projecting from the second polymeric surface;

(i) the first zipper profile and the second zipper profile being constructed and arranged to selectively mate and unmate the zipper closure being configured to unmate from the first side of the zipper closure by a first unmating force and to unmate from a second side opposite the first side by a second unmating force, the first unmating force being greater than the second unmating force;

(e) the color of the first profile member providing a visual indication of the first side of the zipper closure profile requiring the first unmating force.

2. A zipper closure according to claim 1 wherein:

(a) at least one of the first and second zipper profiles includes a male profile member;

(b) at least one of the first and second zipper profiles includes a female profile member opposing the male profile member and adapted to receive the male profile member; and (c) at least one of the first and second zipper profiles includes a post.

3. A zipper closure according to claim 2 wherein:

(a) the first zipper profile includes the post; and (b) the post has the first visible color and remaining ones of the profile members on the first zipper profile are clear.

4. A zipper closure according to claim 2 wherein:

(a) the first zipper profile includes the post; and (b) the post has the first visible color and remaining ones of the profile members on the first zipper profile are a color different from the first visible color.

5. A zipper closure according to claim 2 wherein:

(a) the first zipper profile includes the post and the male profile member; and (b) the post has the first visible color and the male profile is one of at least clear or a color different from the first visible color.

6. A zipper closure according to claim 5 wherein:

(a) the post is visibly colored red, green, yellow, or blue and the male profile is one of at least clear or a color different from the post color.

* * * * *

UNITED STATES PATENT AND TRADEMARK OFFICE

CERTIFICATE OF CORRECTION

PATENT NO. : 7,743,474 B2
APPLICATION NO. : 11/382136
DATED : June 29, 2010
INVENTOR(S) : May It is certified that error appears in the above-identified patent and that said Letters Patent is hereby corrected as shown below:

Col. 6, line 19, claim 1: "and unmate the zipper" should read --and unmate, the zipper--

Signed and Sealed this

Ninth Day of November, 2010

David J. Kappos

David J. Kappos
*Director of the United States Patent and Trademark Office*